US009214107B2

(12) United States Patent
Fish et al.

(10) Patent No.: US 9,214,107 B2
(45) Date of Patent: Dec. 15, 2015

(54) ACTIVE MATRIX DISPLAY DEVICE COMPENSATING FOR AGEING OF THE DISPLAY ELEMENT AND VARIATIONS IN DRIVE TRANSISTOR THRESHOLD VOLTAGE

(75) Inventors: David A. Fish, Haywards Heath (GB); Jason R. Hector, Redhill (GB)

(73) Assignee: Koninklijke Philips N.V., Eindhoven (NL)

( * ) Notice: Subject to any disclaimer, the term of this patent is extended or adjusted under 35 U.S.C. 154(b) by 1044 days.

(21) Appl. No.: 10/569,686

(22) PCT Filed: Aug. 26, 2004

(86) PCT No.: PCT/IB2004/002830

§ 371 (c)(1),
(2), (4) Date: Feb. 27, 2006

(87) PCT Pub. No.: WO2005/022498

PCT Pub. Date: Mar. 10, 2005

(65) Prior Publication Data

US 2006/0256048 A1 Nov. 16, 2006

(30) Foreign Application Priority Data

Sep. 2, 2003 (GB) ..... 0320503.6

(51) Int. Cl.
*G09G 3/32* (2006.01)
*G09G 3/20* (2006.01)

(52) U.S. Cl.
CPC ..... *G09G 3/3233* (2013.01); *G09G 3/2014* (2013.01); *G09G 2300/0417* (2013.01);

(Continued)

(58) Field of Classification Search
CPC ..... G09G 3/3233; G09G 3/2014; G09G 2300/0417; G09G 2300/0809; G09G 2300/0842; G09G 2310/0251; G09G 2310/066; G09G 2320/0295; G09G 2320/043; G09G 2320/045; G09G 2360/148
USPC ..... 345/76–83, 207; 313/463; 315/169.3; 348/800–803
See application file for complete search history.

(56) References Cited

U.S. PATENT DOCUMENTS 6,229,506 B1 * 5/2001 Dawson et al. ..... 345/82
6,356,029 B1 * 3/2002 Hunter ..... 315/169.1

(Continued)

FOREIGN PATENT DOCUMENTS

EP 0717446 A2 6/1996
EP 1096466 A1 5/2001

(Continued)

OTHER PUBLICATIONS

"A Comparison of Pixel Circuits for Active Matrix Polymer/Organic LED Displays," D. Fish et al., SID 02 Digest, pp. 968-971.*

*Primary Examiner* — Temesgh Ghebretinsae
*Assistant Examiner* — Keith Crawley

(57) ABSTRACT

An active matrix LED display has a light-dependent device for detecting the brightness of the display element and threshold voltage measurement circuitry for measuring a threshold voltage of a pixel the drive transistor. Compensation for ageing of the display element is thus provided by an optical feedback path, and compensation for drive transistor threshold variations is provided by measurement of the threshold voltage. This provides a reliable compensation scheme for the threshold voltage variations, while also providing ageing compensation.

26 Claims, 6 Drawing Sheets

(52) U.S. Cl.
CPC ..... *G09G2300/0809* (2013.01); *G09G 2300/0819* (2013.01); *G09G 2300/0842* (2013.01); *G09G 2310/0251* (2013.01); *G09G 2310/066* (2013.01); *G09G 2320/0295* (2013.01); *G09G 2320/043* (2013.01); *G09G 2320/045* (2013.01); *G09G 2360/148* (2013.01)

(56) References Cited

U.S. PATENT DOCUMENTS

| | | | | |
|---|---|---|---|---|
| 6,392,617 | B1 * | 5/2002 | Gleason | 345/82 |
| 6,518,962 | B2 * | 2/2003 | Kimura et al. | 345/211 |
| 6,861,810 | B2 * | 3/2005 | Rutherford | 315/169.3 |
| 7,106,285 | B2 * | 9/2006 | Naugler | 345/87 |
| 7,158,129 | B2 * | 1/2007 | Nakajima | 345/207 |
| 2002/0089357 | A1 * | 7/2002 | Pae et al. | 327/112 |
| 2003/0016190 | A1 * | 1/2003 | Kondo | 345/55 |
| 2003/0103022 | A1 * | 6/2003 | Noguchi et al. | 345/77 |
| 2003/0142047 | A1 * | 7/2003 | Inoue et al. | 345/82 |

FOREIGN PATENT DOCUMENTS

| | | | | |
|---|---|---|---|---|
| GB | 2389951 | * | 12/2003 | G09G 3/32 |
| GB | 2389951 | A | 12/2003 | |
| WO | 9636959 | A2 | 11/1996 | |
| WO | 0120591 | A1 | 3/2001 | |
| WO | 03038790 | A2 | 5/2003 | |

* cited by examiner

ACTIVE MATRIX DISPLAY DEVICE COMPENSATING FOR AGEING OF THE DISPLAY ELEMENT AND VARIATIONS IN DRIVE TRANSISTOR THRESHOLD VOLTAGE

This invention relates to active matrix display devices, particularly but not exclusively active matrix electroluminescent display devices having thin film switching transistors associated with each pixel.

Matrix display devices employing electroluminescent, light-emitting, display elements are well known. The display elements may comprise organic thin film electroluminescent elements, for example using polymer materials, or else light emitting diodes (LEDs) using traditional III-V semiconductor compounds. Recent developments in organic electroluminescent materials, particularly polymer materials, have demonstrated their ability to be used practically for video display devices. These materials typically comprise one or more layers of a semiconducting conjugated polymer sandwiched between a pair of electrodes, one of which is transparent and the other of which is of a material suitable for injecting holes or electrons into the polymer layer.

The polymer material can be fabricated using a CVD process, or simply by a spin coating technique using a solution of a soluble conjugated polymer. Ink-jet printing may also be used. Organic electroluminescent materials can be arranged to exhibit diode-like I-V properties, so that they are capable of providing both a display function and a switching function, and can therefore be used in passive type displays. Alternatively, these materials may be used for active matrix display devices, with each pixel comprising a display element and a switching device for controlling the current through the display element.

Display devices of this type have current-addressed display elements, so that a conventional, analogue drive scheme involves supplying a controllable current to the display element. It is known to provide a current source transistor as part of the pixel configuration, with the gate voltage supplied to the current source transistor determining the current through the display element. A storage capacitor holds the gate voltage after the addressing phase.

FIG. 1 shows a known pixel circuit for an active matrix addressed electroluminescent display device. The display device comprises a panel having a row and column matrix array of regularly-spaced pixels, denoted by the blocks 1 and comprising electroluminescent display elements 2 together with associated switching means, located at the intersections between crossing sets of row (selection) and column (data) address conductors 4 and 6. Only a few pixels are shown in the Figure for simplicity. In practice there may be several hundred rows and columns of pixels. The pixels 1 are addressed via the sets of row and column address conductors by a peripheral drive circuit comprising a row, scanning, driver circuit 8 and a column, data, driver circuit 9 connected to the ends of the respective sets of conductors.

The electroluminescent (EL) display element 2 comprises an organic light emitting diode, represented here as a diode element (LED) and comprising a pair of electrodes between which one or more active layers of organic electroluminescent material is sandwiched. The display elements of the array are carried together with the associated active matrix circuitry on one side of an insulating support. Either the cathodes or the anodes of the display elements are formed of transparent conductive material. The support is of transparent material such as glass and the electrodes of the display elements 2 closest to the substrate may consist of a transparent conductive material such as indium tin oxide (ITO) so that light generated by the electroluminescent layer is transmitted through these electrodes and the support so as to be visible to a viewer at the other side of the support. Typically, the thickness of the organic electroluminescent material layer is between 100 nm and 200 nm. Typical examples of suitable organic electroluminescent materials which can be used for the elements 2 are known and described in EP-A-0 717446. Conjugated polymer materials as described in WO96/36959 can also be used.

FIG. 2 shows in simplified schematic form a known pixel and drive circuitry arrangement for providing voltage-addressed operation. Each pixel 1 comprises the EL display element 2 and associated driver circuitry. The driver circuitry has an address transistor 16 which is turned on by a row address pulse on the row conductor 4. When the address transistor 16 is turned on, a voltage on the column conductor 6 can pass to the remainder of the pixel. In particular, the address transistor 16 supplies the column conductor voltage to a current source 20, which comprises a drive transistor 22 and a storage capacitor 24. The column voltage is provided to the gate of the drive transistor 22, and the gate is held at this voltage by the storage capacitor 24 even after the row address pulse has ended.

The drive transistor 22 in this circuit is implemented as an n-type TFT, and the storage capacitor 24 holds the gate-source voltage fixed. This results in a fixed source-drain current through the transistor, which therefore provides the desired current source operation of the pixel. The n-type drive transistor can be implemented using amorphous silicon. The drive transistor can be implemented as a p-type transistor, and this will normally be appropriate for implementation using polysilicon, and there will of course be other circuit changes.

In the above basic pixel circuit, for circuits based on polysilicon, there are variations in the threshold voltage of the transistors due to the statistical distribution of the polysilicon grains in the channel of the transistors. Polysilicon transistors are, however, fairly stable under current and voltage stress, so that the threshold voltages remain substantially constant.

There is much interest in implementing amorphous silicon pixel circuits for active matrix LED displays. This is becoming possible as the electrical current requirements for the LED devices is reducing with improved efficiency devices. For example, organic LED devices and solution processed organic LED devices have recently shown extremely high efficiencies through the use of phosphorescence. The variation in threshold voltage is small in amorphous silicon transistors, at least over short ranges over the substrate, but the threshold voltage is very sensitive to voltage stress. Application of the high voltages above threshold needed for the drive transistor causes large changes in threshold voltage, which changes are dependent on the information content of the displayed image. This ageing is a serious problem in LED displays driven with amorphous silicon transistors.

In addition to variations in transistor characteristics there is also differential ageing in the LED itself. This is due to a reduction in the efficiency of the light emitting material after current stressing. In most cases, the more current and charge passed through an LED, the lower the efficiency.

There have been proposals for voltage-addressed pixel circuits which compensate for the aging of the LED material. For example, various pixel circuits have been proposed in which the pixels include a light sensing element. This element is responsive to the light output of the display element and acts to leak stored charge on the storage capacitor in response to the light output, so as to control the integrated light output of the display during the address period. FIG. 3 shows one example of pixel layout for this purpose using a p-type drive transistor. Examples of this type of pixel configuration are described in detail in WO 01/20591 and EP 1 096 466.

In the pixel circuit of FIG. 3, a photodiode 27 discharges the gate voltage stored on the capacitor 24. The EL display element 2 will no longer emit when the gate voltage on the drive transistor 22 reaches the threshold voltage, and the storage capacitor 24 will then stop discharging. The rate at which charge is leaked from the photodiode 27 is a function of the display element output, so that the photodiode 27 functions as a light-sensitive feedback device. It can be shown that the integrated light output, taking into the account the effect of the photodiode 27, is given by:

$$L_T = \frac{C_S}{\eta_{PD}}(V(0) - V_T) \quad [1]$$

In this equation, $\eta_{PD}$ is the efficiency of the photodiode, which is very uniform across the display, $C_S$ is the storage capacitance, V(0) is the initial gate-source voltage of the drive transistor and $V_T$ is the threshold voltage of the drive transistor. The light output is therefore independent of the EL display element efficiency and thereby provides aging compensation. However, for a low temperature polysilicon TFT, $V_T$ varies across the display so it will exhibit non-uniformity. Reference is made to the paper "A comparison of pixel circuits for Active Matrix Polymer/Organic LED Displays" by D. A. Fish et al., 32.1, SID 02 Digest, May 2002.

There are refinements to this basic circuit, but the problem remains that practical voltage-addressed circuits are still susceptible to threshold voltage variations.

For an amorphous silicon drive transistor, the circuit of FIG. 3 would not compensate for the stress induced threshold voltage variations of the amorphous silicon drive transistor.

There have also been a number of proposals for voltage-addressed pixel circuits which compensate for changes in the threshold voltages of the drive transistors used resulting from ageing. Some of these proposals introduce additional circuit elements into each pixel so that the threshold voltage of the drive transistor can be measured, typically every frame. One way to measure the threshold voltage is to switch on the drive transistor as part of the addressing sequence, and to isolate the drive transistor in such a way that the drive transistor current discharges a capacitor across the gate-source junction of the drive transistor. At a certain point in time, the capacitor is discharged to the point where it holds the threshold voltage of the drive transistor, and the drive transistor stops conducting. The threshold voltage is then stored (i.e. measured) on the capacitor. This threshold voltage can then be added to a data input voltage (again using circuit elements within the pixel) so that the gate voltage provided to the drive transistor takes into account the threshold voltage.

According to the invention, there is provided an active matrix display device comprising an array of display pixels, each pixel comprising:

a current-driven light emitting display element;

a drive transistor for driving a current through the display element;

a storage capacitor for storing a pixel drive voltage to be used for addressing the drive transistor;

a light-dependent device for detecting the brightness of the display element; and compensation circuitry for generating a compensation voltage for combination with pixel data voltages to derive the pixel drive voltage, and for applying the pixel drive voltage such as to compensate for threshold voltage variations of the drive transistor and ageing of the display element.

This arrangement compensates both for display element ageing and threshold voltage variations.

Preferably, the compensation circuitry comprises threshold voltage measurement circuitry for measuring a threshold voltage of the drive transistor for combination with a pixel data signal to derive the pixel drive voltage.

In this circuit, compensation for ageing of the display element is provided by an optical feedback path, and compensation for drive transistor threshold variations is provided by measurement of the threshold voltage. This provides a reliable compensation scheme for the threshold voltage variations, whilst also providing ageing compensation.

A discharge transistor may be provided for discharging the storage capacitor thereby to switch off the drive transistor. In this case, the timing of operation of the discharge transistor can be used to control the light output, and this timing can depend on the light output, so as to implement the optical feedback system.

Thus, threshold compensation is carried out during pixel addressing, whereas ageing compensation is carried out during pixel driving. For example, the light-dependent device can control the timing of the operation of the discharge transistor by varying the gate voltage applied to the discharge transistor in dependence on the light output of the display element.

A timing switch may be provided between the gate of the discharge transistor and the light dependent device. When sufficient charge has been generated in the light dependent device, the timing switch is closed, thereby actuating the discharge transistor.

Each pixel may further comprise a sense transistor connected between the source of the drive transistor and a sense line. This sense line is then connected to the threshold voltage measurement circuitry. When the drive transistor is turned on, a current can flow through the sense transistor to the threshold voltage measurement circuitry, and this can be used to measure the threshold voltage, for example by providing a synchronised ramp signal to the gate of the drive transistor.

In another embodiment, the light dependent device is connected in series with a switch between the gate and source of the drive transistor. When the switch is closed, the light dependent device acts to discharge the gate-source capacitance (which may parasitic or an additional component). Additional current is thus drawn by the pixel for a given output, and this additional current depends on the light output. This circuit thus provides a way of detecting the light output. The storage capacitor is preferably connected between the gate and source of the drive transistor.

In this arrangement, the compensation circuitry preferably comprises means for applying a ramped voltage input to the pixel, and means for measuring the light dependent device output thereby to determine the voltage input of the ramp corresponding to a predetermined display element brightness.

In this arrangement, the threshold voltage and ageing compensation is carried out during the pixel addressing phase.

In yet another embodiment, the light dependent device is connected in series with a sense transistor between a power supply line and a sense line. The current generated in the light dependent device can be measured on the sense line to provide the measure of the light output.

In this arrangement, the compensation circuitry preferably comprises means for applying a predetermined voltage as input to the pixel, and means for measuring the light dependent device output thereby to determine the light output corresponding to the predetermined voltage input. The determined light output is then used to derive a compensation scheme which compensates for the drive transistor threshold voltage and the display element ageing.

In this arrangement, the threshold voltage and ageing compensation is again carried out during the pixel addressing phase.

Thus, in some embodiments of the invention, the optical feedback is used during pixel illumination to adjust the period of illumination. In other embodiments, the optical feedback is used during pixel addressing for modification of the pixel drive signal to generate the required drive signal for the period of illumination. In each case, however, optical feedback is combined with threshold sensing to provide complete compensation of pixel characteristics.

The invention allows amorphous silicon n-type transistors to be used in the pixel circuits.

The invention also provides a method of driving an active matrix display device comprising an array of display pixels each comprising a drive transistor and a current-driven light emitting display element, the method comprising, for each addressing of the pixel:

deriving a pixel drive voltage which takes into account at least the threshold voltage of the drive transistor;

sensing the light output of the display element; and deriving a pixel drive scheme which is dependent on the threshold voltage and the light output, and applying the pixel drive scheme to the pixel.

The invention will now be described by way of example with reference to the accompanying drawings, in which.

Figure 1:
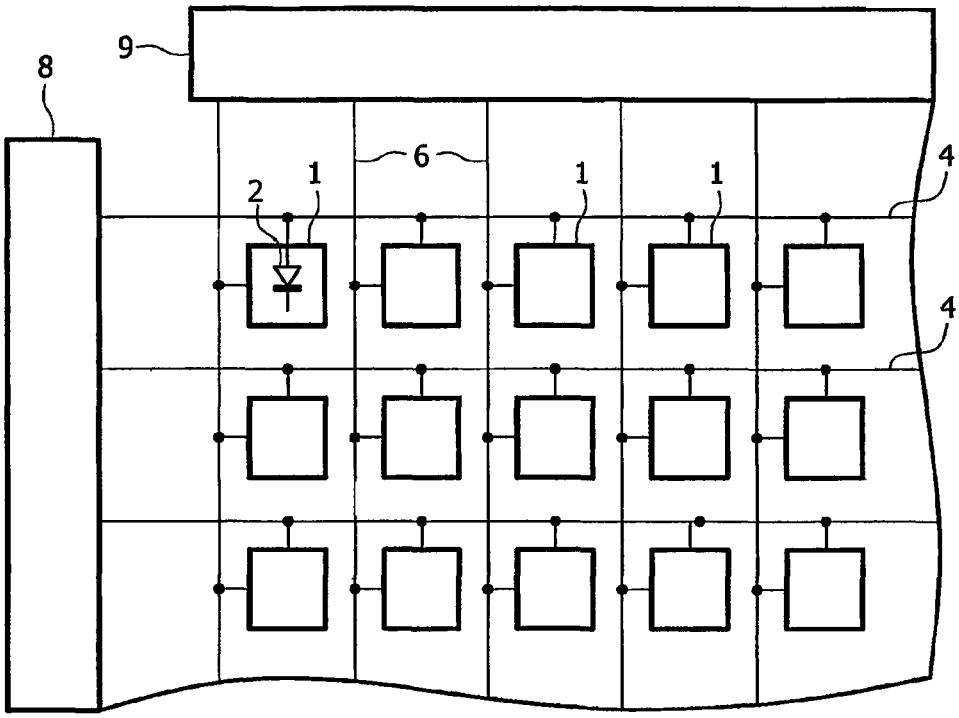
FIG. 1 PRIOR ART
FIG. 1 shows a known EL display device.
Figure 2:
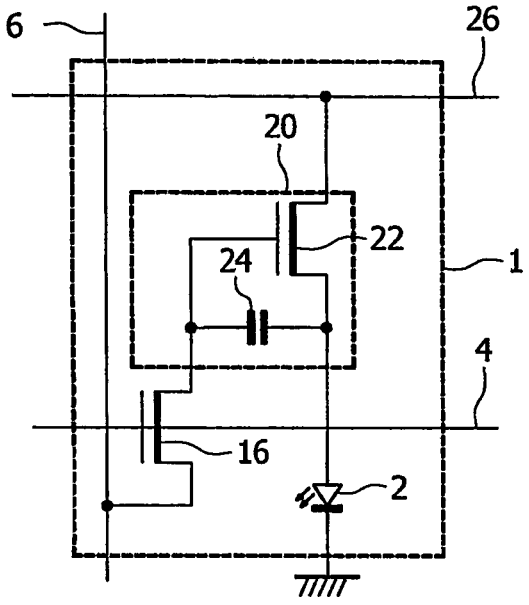
FIG. 2 PRIOR ART
FIG. 2 is a simplified schematic diagram of a known pixel circuit for current-addressing the EL display pixel.
Figure 3:
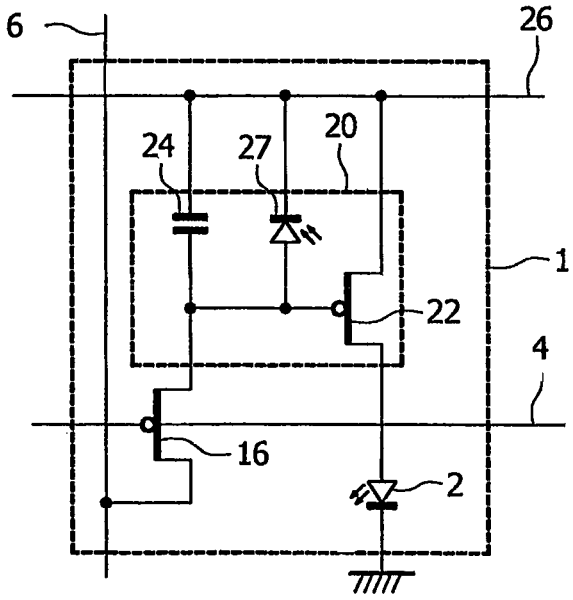
FIG. 3 PRIOR ART
FIG. 3 shows a known pixel design which compensates for differential aging.

It should be noted that these figures are diagrammatic and not drawn to scale. Relative dimensions and proportions of parts of these figures have been shown exaggerated or reduced in size, for the sake of clarity and convenience in the drawings.

Figure 4:
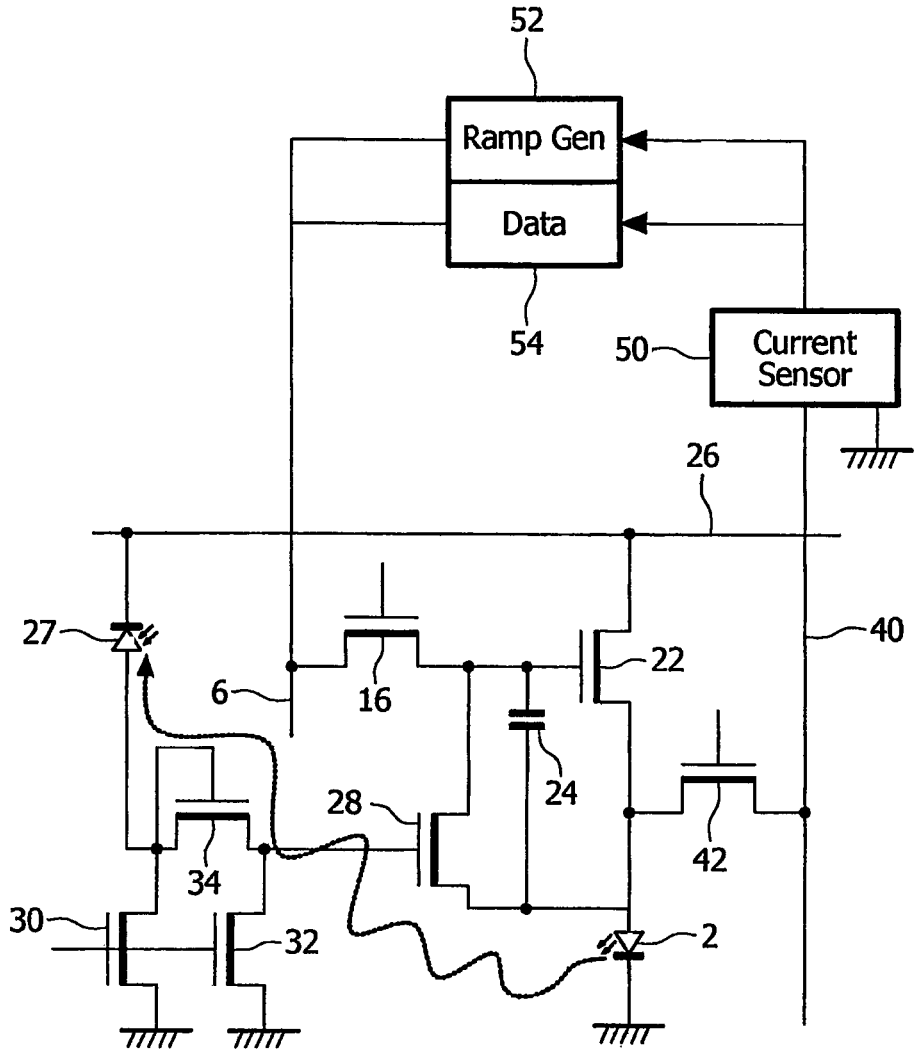
FIG. 4 shows a first example of display device of the invention.

FIG. 4 shows a first display device pixel of the invention. The pixel has the conventional address transistor 16, drive transistor 22, display element 2 and storage capacitor 24 (which may be a parasitic capacitance of the transistor 22). A discharge transistor 28 is provided for discharging the storage capacitor 24 in response to an indication that the (integrated) light output has reached the desired level.

The discharge transistor is controlled in part by a light-dependent device, particularly a photodiode 27, for detecting the brightness of the display element. During illumination of the photodiode 27 (and with transistors 30,32 off) the photodiode current charges the gate-source parasitic capacitance of the transistor 34 until it is turned on. This in turn switches on the discharge transistor 28, which discharges the capacitor 24. Thus, the transistor 34 functions as a timing switch between the gate of the discharge transistor and the light dependent device. When sufficient charge has been generated in the light dependent device, the timing switch is closed, thereby actuating the discharge transistor.

The light dependent device can be a diode-connected phototransistor instead of the photodiode shown. The transistor 34 is diode-connected and can instead be implemented as a diode.

A brighter display output results in more rapid charging of the transistor parasitic capacitance and therefore more rapid switch off of the drive transistor 22. Thus, a feedback scheme is implemented which compensates for ageing of the display element.

The circuit further has threshold voltage measurement circuitry for measuring a threshold voltage of the drive transistor 22 and for modifying a pixel data signal to derive the pixel drive voltage. Thus, compensation for drive transistor threshold variations is provided by measurement of the threshold voltage.

For measuring the drive transistor 22 threshold voltage, a sense line 40 is connected to a virtual earth current sensor 50. The source of the drive transistor 22 is connected to the sense line 40 through a sense transistor 42. The sensor 50 measures current without allowing any change in the voltage on the sense line 40, so that very small currents can be sensed. The current sensor controls the operation of a ramp voltage generator 52.

At the start of each field period of the display, the pixel circuit is used to carry out a threshold voltage measurement operation.

For the threshold measurement operation, address transistor 16 and the sense transistor 42 are turned on. The gate of the drive transistor 22 is then discharged to the voltage on the data column 6 which at that time is arranged to be less than the threshold voltage of the drive transistor 22, so that it is turned off. The anode of the LED display element 2 is also held at the voltage of the sense line 40, which is ground. The power rail 26 is high.

The ramp generator 52 then increases the voltage on the column 6, either linearly or in stepwise manner, for example by increasing the voltage output of a buffer, or by injecting charge to the column. The gate of the drive transistor 22 follows the column voltage until the drive transistor turns on, and current is then injected to the sense line 40 and is detected by the current sensor 50. At this time, the voltage output of the ramp generator is stored and is used as a measure of the threshold voltage of the drive transistor.

The measured threshold voltage is then added to the desired data voltage for the pixel, either in the analogue or digital domains, for example digitally in the source driver circuit. The threshold voltage could also be added in the pixels themselves (analogue).

In this way, the pixel drive signals for the plurality of display pixels are modified in response to the measured threshold voltage The circuit of FIG. 4 is used in two modes. In an addressing mode, the threshold voltage is measured in the manner described above, and this is then added to the pixel drive voltage to charge the storage capacitor 24 to the new compensated value. In the subsequent driving mode, the display is driven to this compensated value, until the drive transistor 22 is turned off by the optical feedback system.

Figure 5:
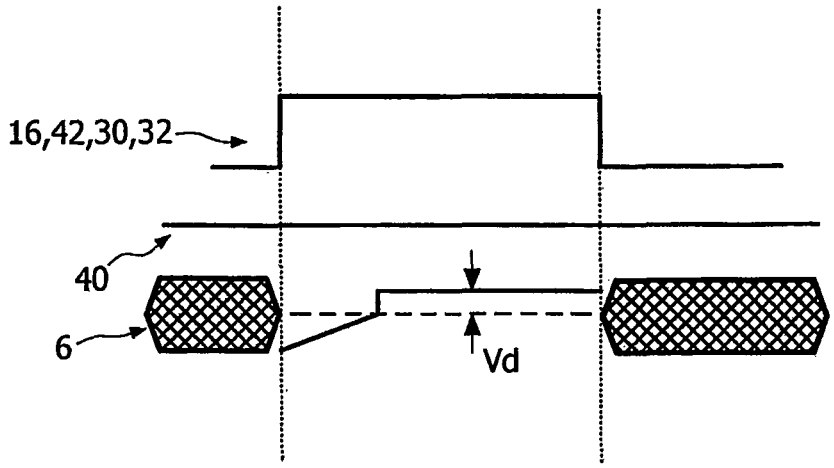
FIG. 5 is a first timing diagram to explain the operation of the circuit of FIG. 4.

A first timing diagram for the circuit of FIG. 4 is shown in FIG. 5.

The control transistors 16, 42, 30, 32 are all controlled by a single control line, which turns all of these transistors on during the addressing phase and off during the subsequent pixel driving stage.

At the start of the addressing phase, the voltage ramp described above is placed on the column 6. When the current flow is detected on the sense line 40, the ramp level is stored, and a pixel drive voltage Vd is added to the threshold voltage level. The resulting voltage is provided on the column 6 for the charging of the storage capacitor 24. During the addressing phase, the anode is held at the voltage on the sense line 40 (e.g. 0V) so that the display element is turned off.

The transistors 30,32 ensure that the transistor 34 (the timing switch) and the discharge transistor 28 are turned off during addressing, so that they play no part in the circuit operation during addressing.

The transistor 34 is provided to speed up the turn on of the discharge transistor 28 thereby effecting a fast turn off of the display element 2. If the gate of the discharge transistor 28 is allowed to charge slowly, a current will be drawn from the capacitor 24 which reduces the light output and thereby reduces the photocurrent in the photodiode 27. This tends to slow down the feedback loop. The transistor 34 thus provides a rapid turn off characteristic for the feedback loop. The discharge transistor is thus not affected by the feedback loop until the transistor 34 has been turned on, and this removes any dependency of the circuit operation on the threshold voltage of the discharge transistor 28. The use of the diode-connected transistor 34 enables circuit operation with only one additional address line.

At the end of the addressing phase, the control transistors are all turned off, and the display element 2 is turned on. The optical feedback scheme is also activated, so that the drive transistor 22 will be turned off more quickly for a bright pixel than for a dim pixel, thereby compensating for pixel brightness variations resulting from ageing.

The data voltage added to the threshold voltage will take account of the effect of the optical feedback circuitry so that the desired circuit operation is achieved.

Figure 6:
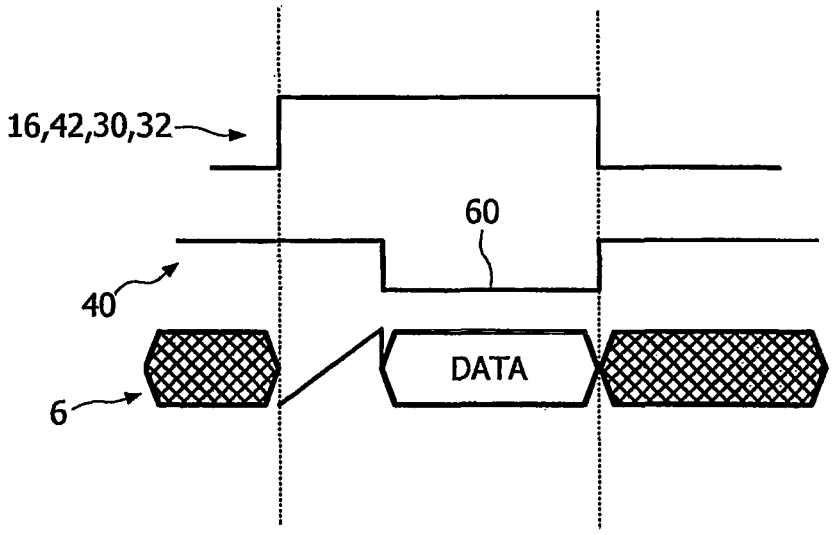
FIG. 6 is a second timing diagram to explain an alternative operation of the circuit of FIG. 4.

FIG. 6 is a second timing diagram for the circuit of FIG. 4.

In this version, once the threshold voltage has been measured, a corresponding negative step 60 is provided on the sense line 40, so that applying the unmodified data voltage to the data line 6 results in the combination of the data voltage and the threshold voltage being stored on the capacitor 24 (which is effectively connected between the sense line 40 and the data line 6).

In the embodiment above, the threshold compensation is carried out during addressing and the ageing compensation is during pixel driving.

Figure 7:
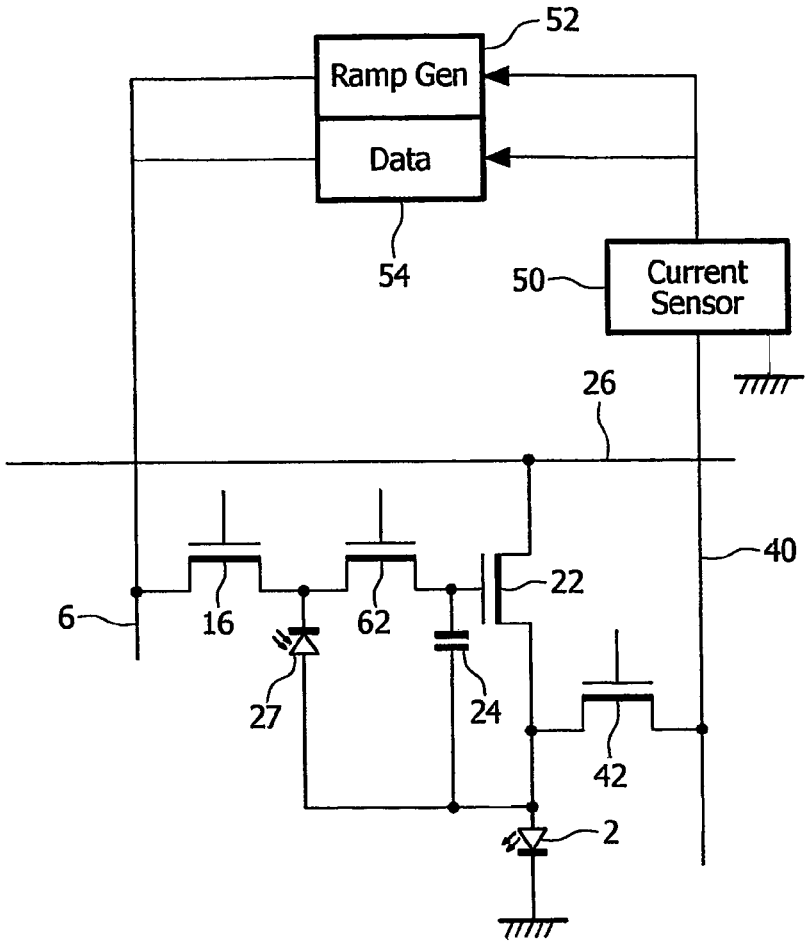
FIG. 7 shows a second example of display device of the invention.

FIG. 7 shows a second embodiment, in which all compensation is carried out during the addressing phase.

The photodiode 27 is connected in series with a transistor switch 62 between the gate and source of the drive transistor 22. When the switch 62 is closed, the photodiode discharges the gate-source capacitor 24. The current drawn by the pixel is thus dependent on the light output, so that a measurement of the current drawn can be used to determine the pixel brightness. The photodiode discharge current can be measured on sense line 40, and this is independent of the display element current. The display element current is constant, because a constant voltage is on the LED anode because the transistor 42 is turned on. Thus, the photodiode current can be measured, giving a measure of the display element brightness. By considering the pixel brightness for given drive conditions a measure of the ageing of the pixel is obtained.

This circuit has the same circuit elements for measuring the drive transistor threshold voltage. However, a measure of the effect of pixel ageing on the brightness is also obtained during addressing, so that compensation can be carried out in the column driver, and there is no need for the optical feedback scheme to operate during pixel driving.

The control transistors 16, 42, 62 are again controlled by a single control line. In this circuit, the display element 2 must be driven during addressing in order to provide the optical feedback signal. Most easily, the pixel can be addressed to find the required gate-source voltage for a given sense line current, corresponding to a given output brightness.

Figure 8:
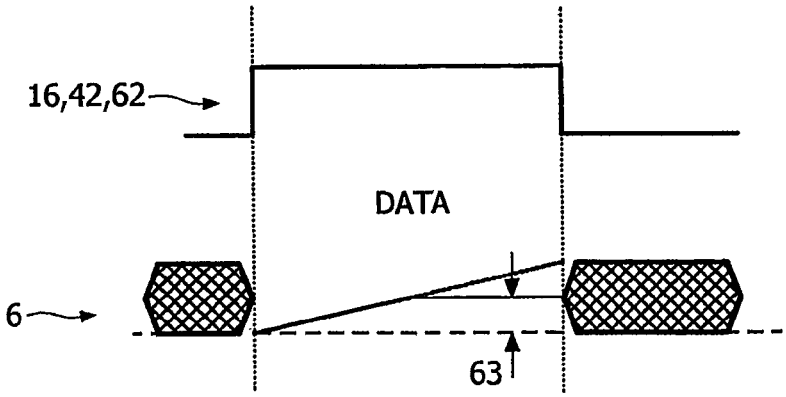
FIG. 8 is a timing diagram to explain the operation of the circuit of FIG. 7.

FIG. 8 shows an example of timing diagram for the circuit of FIG. 7. As shown, the control transistors 16,42,62 are all on during addressing so that the voltage on the line 6 is applied across the gate-source of the drive transistor 22 and any light-dependent current is measured on the sense line.

The ramp is applied to the line 6, and the ramp is stopped when the correct current is detected through the sense line. The gate source voltage 63 at that time then corresponds to a known brightness, and this information can be used to compensate both for the threshold voltage of the drive transistor and the ageing of the LED material. This information can then be used to modify the data applied to the pixel.

Figure 9:
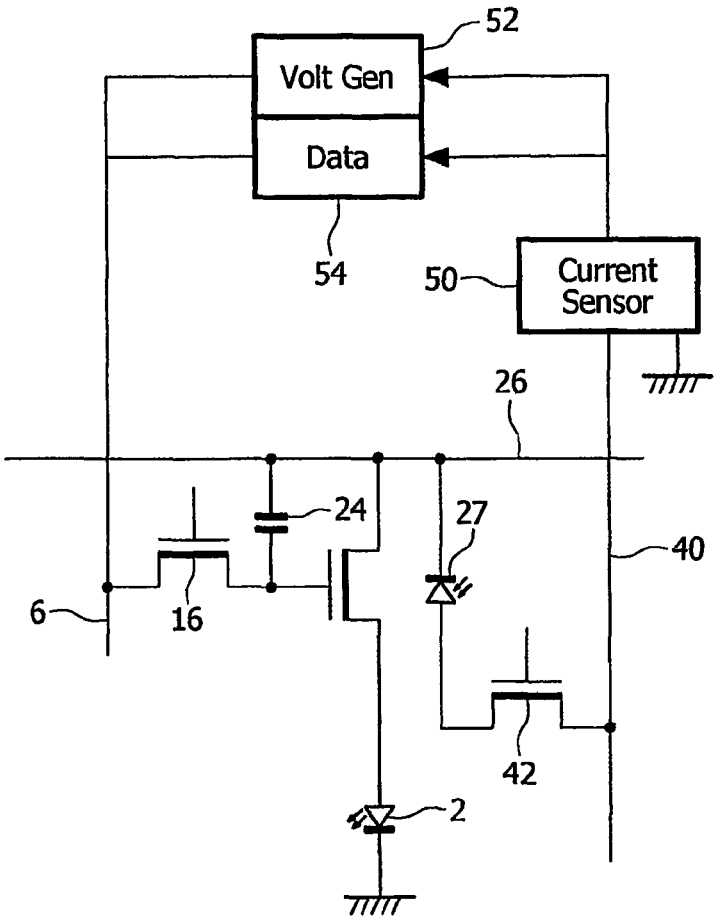
FIG. 9 shows a third example of display device of the invention.

In another embodiment, shown in FIG. 9, the photodiode is connected in series with the sense transistor 42 between the power supply line 26 and the sense line 40. The current generated in the light dependent device can be measured on the sense line to provide the measure of the light output.

In this circuit, current sensing of the current provided on the data line 6 is used to detect turn on of the drive transistor 22. Current sensing of the current flowing to the sense line 40 is used to provide a measure of the display element brightness (for given drive conditions).

The storage capacitor in this circuit is between the gate and drain of the drive transistor. The light output will therefore be dependent on the anode voltage of the display element, as this will influence the gate-source voltage. However, the light output measurement enables the pixel drive signals to be modified to account for LED anode voltage variations as well as for ageing of the LED material and drive transistor threshold voltage variations.

Figure 10:
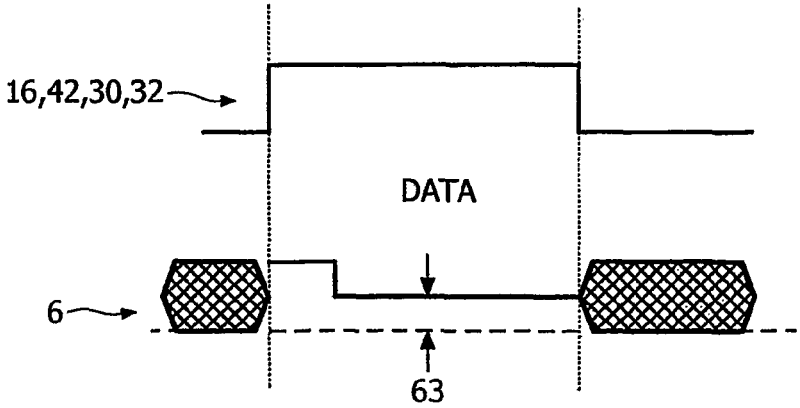
FIG. 10 is a timing diagram to explain the operation of the circuit of FIG. 9.

FIG. 10 shows an example of timing diagram for the circuit of FIG. 9. The control transistors 16,42 are both on during addressing so that the display element 2 is emitting light in response to the signal on the data line 6, and at the same time the photodiode current is measured on the sense line 40. As shown in FIG. 10, a reference voltage is initially applied to the column 6. This reference voltage is high enough to overcome the threshold voltage of the drive transistor and causes a flash from the LED, which allows a photocurrent to be measured.

From the measured photocurrent, the difference between the expected brightness corresponding to the applied reference voltage and the actual measured brightness is determined. This difference is used to calculate the adjustment required to the data voltages, as represented by arrow 63.

In some embodiments of the invention, the optical feedback is used during pixel illumination to adjust the period of illumination. In other embodiments, the optical feedback is used for modification of the pixel drive signal to generate the required drive signal for the period of illumination. In each case, however, optical feedback is combined with threshold sensing to provide complete compensation of pixel characteristics.

The invention allows amorphous silicon n-type transistors to be used in the pixel circuits, and circuits have been shown using only n-type transistors. A number of technologies are however possible, for example crystalline silicon, hydrogenated amorphous silicon, polysilicon and even semiconducting polymers. Although the invention has particular benefit in enabling implementation of drive circuits using n-type amorphous silicon transistors, implementation in other technologies and with p-type transistors may be desirable in some cases. These are all intended to be within the scope of the invention as claimed.

The display devices may be polymer LED devices, organic LED devices, phosphor containing materials and other light emitting structures.

In the circuits above, the circuit connections are made to the LED anode, and this allows a common cathode to be used. It may instead be desired to use a structured cathode with circuit connections made to the cathode. The circuit modifications required will be apparent to those skilled in the art.

In the circuits above the modification of the pixel drive voltage to take account of the threshold voltage and LED ageing is performed externally of the display pixel array, for example in the column driver circuitry. An alternative is to provide compensation in the pixel. Various schemes have been proposed for threshold voltage compensation, and typically involve storing the threshold voltage on one capacitor in series with the capacitor on which the data voltage is provided. The invention can thus employ external threshold voltage measurement, but rather than modifying the pixel drive signals as described above, the threshold voltage can then be provided on a capacitor within the pixel circuit, and the unmodified data voltage can be provided on the data (column) conductor.

Various other modifications will be apparent to those skilled in the art.

The invention claimed is:

1. An active matrix display device comprising:

an array of display pixels, respective pixels of the array comprising:

a current-driven light emitting display element;

a drive transistor communicating with the display element and configured for driving a first current through the display element to emit light from the display element;

a storage capacitor communicating with a gate of the drive transistor and communicating with the display element, the storage capacitor configured to store a pixel drive voltage to control the drive transistor to drive and stop driving the first current, to control the drive transistor to drive and stop driving the first current through the display element, the storage capacitor is discharged at a first rate to compensate for ageing of the display element;

a light-dependent device configured for detecting the brightness of the display element, and providing an output on which the first rate depends;

a measuring circuit configured to measure the output of the light-dependent device and based on the measured output, to determine an input voltage of a ramp corresponding to a predetermined brightness;

a compensation circuit configured for combining a compensation voltage including a measured threshold voltage of the drive transistor, with the pixel drive voltage, to compensate for variations in the threshold voltage of the drive transistor;

a discharge transistor for discharging the storage capacitor thereby to switch off the drive transistor, wherein the storage capacitor communicates between the source and drain of the discharge transistor, wherein a diode-connected timing switch is connected to the gate of the discharge transistor between the gate of the discharge transistor and the light-dependent device.

2. The device of claim 1, wherein the compensation circuit comprises threshold voltage measurement circuit for measuring the threshold voltage of the drive transistor.

3. The device of claim 1, wherein the light-dependent device controls the timing of the operation of the discharge transistor by varying the gate voltage applied to the discharge transistor depending on light output of the display element.

4. The device of claim 3, wherein the light-dependent device controls the timing of the switching of the discharge transistor from an off to an on state.

5. The device of claim 1, comprising a sense line and a sense transistor connected between the source of the drive transistor and the sense line.

6. The device of claim 1, wherein the light-dependent device is connected in series with a switch between the gate and source of the drive transistor.

7. The device of claim 6, wherein the storage capacitor is connected between the gate and source of the drive transistor.

8. The device of claim 1, wherein the compensation circuit comprises a circuit for applying the ramped input voltage to the pixel.

9. The device of claim 8, wherein the determined input voltage of the ramp is used as the compensation voltage to compensate for the drive transistor threshold voltage and the display element ageing.

10. The device of claim 6, comprising a sense line and a sense transistor connected between the source of the drive transistor and the sense line.

11. The device of claim 1, wherein the light-dependent device is connected in series with a sense transistor between a power supply line and a sense line.

12. The device of claim 11, wherein the compensation circuit comprises a circuit for applying a predetermined input voltage to the pixel, and the measuring circuit determines output light corresponding to a predetermined input voltage.

13. The device of claim 12, wherein the determined output light is used to derive a compensation scheme which compensates for the drive transistor threshold voltage and the display element ageing.

14. The device of claim 1, wherein the light dependent device comprises a discharge photodiode.

15. The device of claim 1, comprising an address transistor connected between a data signal line and an input to the pixel.

16. The device of claim 1, wherein the drive transistor is connected between a power supply line and the display element.

17. The device of claim 1, wherein the drive transistors comprise amorphous silicon n-type transistors.

18. The device of claim 1, wherein the current-driven light emitting display element comprises an electroluminescent display element.

19. A method of driving an active matrix display device, the method comprising acts of:

having the active matrix display device comprising an array of display pixels, respective pixels of the array comprising: a drive transistor communicating with a current-driven light emitting display element, and a storage capacitor communicating between a gate of the drive transistor and the display element;

for respective addressing of respective pixels of the array:

storing a pixel drive voltage in the storage capacitor for controlling the drive transistor to drive and stop driving a first current through the display element, to stop driving the first current the storage capacitor is discharged at a first rate compensating for ageing of the display element;

determining compensation voltage from at least a threshold voltage of the drive transistor during an addressing phase of the pixel, using compensation circuitry;

combining the compensation voltage with the pixel drive voltage using the compensation circuitry;

detecting the brightness of the display element using a light-dependent device, and providing an output;

measuring, by a measuring circuit, the output of the light-dependent device to determine the light output of the display element during a driving phase of the pixel, the determined light output determining the first rate;

based on the measured output of the light-dependent device, determining, in a determining unit, an input voltage of a ramp corresponding to a predetermined brightness; and implementing a pixel drive scheme dependent on the threshold voltage and the measured output so the drive transistor will be turned on more quickly for a bright pixel than for a dim pixel, thereby compensating for pixel brightness variations resulting from aging;

respective pixels of the array further comprising:

a discharge transistor for discharging the storage capacitor thereby to switch off the drive transistor, wherein the storage capacitor communicates between the source and drain of the discharge transistor, wherein a diode-connected timing switch is connected to the gate of the discharge transistor between the gate of the discharge transistor and the light-dependent device.

20. The method of claim 19, wherein the pixel drive scheme comprises, during the addressing phase, deriving the pixel drive voltage which takes into account the threshold voltage, and during the driving phase, switching off the drive transistor when the light output voltage reaches a threshold.

21. The method of claim 19, wherein the pixel drive scheme comprises, during the addressing phase, deriving pixel drive voltage which takes into account the threshold voltage and a light output characteristics of the display element.

22. The method of claim 21, wherein the light output voltage is measured for predetermined drive conditions.

23. The method of claim 21, wherein the drive conditions are varied until a predetermined light output is obtained.

24. A method for operating an active matrix display device, the method comprising the acts of:

having the active matrix display device comprising an array of display pixels:

for respective addressing of respective pixels of the array:

emitting light from a current-driven display element;

driving a first current through the display element using a drive transistor communicating with the display element for emitting the light;

storing in a storage capacitor, a pixel drive voltage to control the drive transistor to drive and stop driving the first current through the display element, the storage capacitor is discharged at a first rate compensating for ageing of the display element;

detecting in a light-dependent device, the brightness of the display element, and providing an output on which the first rate depends;

measuring in a measuring circuit, an output of the light-dependent device, and based on the measured output determining input voltage of a ramp corresponding to a predetermined brightness; and combining in a compensation circuit, a compensation voltage including a measured threshold voltage of the drive transistor, with the pixel drive voltage, to compensate for variations in the threshold voltage of the drive transistor;

respective pixels of the array comprising:

a discharge transistor for discharging the storage capacitor thereby to switch off the drive transistor, wherein the storage capacitor communicates between the source and drain of the discharge transistor, wherein a diode-connected timing switch is connected to the gate of the discharge transistor between the gate of the discharge transistor and the light-dependent device.

25. A tangible computer-readable storage medium that is not a transitory propagating signal or wave, the medium being modified with control information including instructions for performing a method for operating an active matrix display device, the method comprising the acts of:

having the active matrix display device comprising an array of display pixels;

for respective pixels of the array of display pixels:

emitting light from a current-driven display element;

driving a first current through the display element using a drive transistor communicating with the display element for emitting the light;

storing in a storage capacitor, a pixel drive voltage to control the drive transistor to drive and stop driving the first current through the display element, the storage capacitor is discharged at a first rate compensating for ageing of the display element;

detecting in a light-dependent device, the brightness of the display element, and providing an output on which the first rate depends;

measuring in a measuring circuit, an output of the light-dependent device, and based on the measured output determining input voltage of a ramp corresponding to a predetermined brightness; and combining in a compensation circuit, a compensation voltage including a measured threshold voltage of the drive transistor with the pixel drive voltage to compensate for variations in the threshold voltage of the drive transistor;

respective pixels of the array comprising:

a discharge transistor for discharging the storage capacitor thereby to switch off the drive transistor, wherein the storage capacitor communicates between the source and drain of the discharge transistor, wherein a diode-connected timing switch is connected to the gate of the discharge transistor between the gate of the discharge transistor and the light-dependent device.

26. An active matrix display device comprising:

an array of display pixels, respective pixels of the array comprising:

a current-driven light emitting display element;

a drive transistor communicating with the display element and configured to drive a first current through the display element to emit light from the display element;

a storage capacitor communicating with a gate of the drive transistor and communicating with the display element, the storage capacitor configured to store a pixel drive voltage to control the drive transistor to drive and stop driving the first current through the display element, the storage capacitor is discharged at a first rate compensating for ageing of the display element, for each addressing of the pixel;

compensation circuitry configured to determine a compensation voltage from at least a threshold voltage of the drive transistor during an addressing phase of the pixel, and to combine the compensation voltage with the pixel drive voltage;

a light-dependent device configured to sense a light output of the display element during a driving phase of the pixel and provide an output on which the first rate depends;

a measuring circuit configured to measure the output of the light-dependent device;

a determining unit to determine an input voltage of a ramp corresponding to a predetermined brightness, based on the measured output, to drive the pixel depending on the threshold voltage and the measured output;

a discharge transistor for discharging the storage capacitor thereby to switch off the drive transistor, wherein the storage capacitor communicates between the source and drain of the discharge transistor, wherein a diode-connected timing switch is connected to the gate of the discharge transistor between the gate of the discharge transistor and the light-dependent device.

* * * * *